US007694711B2

(12) United States Patent
Okachi et al.

(10) Patent No.: US 7,694,711 B2
(45) Date of Patent: Apr. 13, 2010

(54) SCREEN DEVICE

(75) Inventors: Yasubumi Okachi, Yokohama (JP); Yuichiro Nishioka, Yokohama (JP)

(73) Assignee: Metaco Inc., Tokyo (JP)

( * ) Notice: Subject to any disclaimer, the term of this patent is extended or adjusted under 35 U.S.C. 154(b) by 253 days.

(21) Appl. No.: 11/629,462

(22) PCT Filed: Jun. 9, 2005

(86) PCT No.: PCT/JP2005/010990

§ 371 (c)(1),
(2), (4) Date: Nov. 14, 2007

(87) PCT Pub. No.: WO2005/121488

PCT Pub. Date: Dec. 22, 2005

(65) Prior Publication Data

US 2008/0135189 A1 Jun. 12, 2008

(30) Foreign Application Priority Data

Jun. 14, 2004 (JP) ..... 2004-176086

(51) Int. Cl.
*A47G 5/02* (2006.01)

(52) U.S. Cl. ..... 160/245; 160/122

(58) Field of Classification Search ..... 160/122, 160/121.1, 120, 243, 244, 245, 84.06, 265, 160/273.1
See application file for complete search history.

(56) References Cited

U.S. PATENT DOCUMENTS 3,306,344 A * 2/1967 Youngs ..... 160/241
4,096,902 A * 6/1978 Junod ..... 160/122
4,359,081 A * 11/1982 Brower ..... 160/243

(Continued)

FOREIGN PATENT DOCUMENTS

JP 55-27311 2/1980

(Continued)

OTHER PUBLICATIONS

International Search Report issued Sep. 20, 2005 in the International (PCT) Application No. PCT/JP2005/010990.

*Primary Examiner*—David Purol
(74) *Attorney, Agent, or Firm*—Wenderoth, Lind & Ponack L.L.P.

(57) ABSTRACT

There is provided a screen device having a pair of slide guide frames and a slide bar expanding and storing the slide guide frames so that screens can be set up and stored by the movement of the slide bar, wherein a roller pipe having a coil spring mechanism for providing a resilient force integrated therein is arranged between the slide guide frames, pivotally supporting bodies are disposed at both ends of the roller pipe so as to be capable of sliding but not to be capable of rotating with respect to the slide guide frames, one end of two screens are fixed to the roller pipe, and the roller pipe rotates and slides in association with expansion of the slide guide frames or storage thereof into the slide bar in association with the movement of the slide bar to which the other end of one of the screens is fixed, whereby setting up of the screen by withdrawal of the same from the roller pipe and storage of the screen into the roller pipe by winding of the same on the roller pipe are enabled.

20 Claims, 9 Drawing Sheets

U.S. PATENT DOCUMENTS

| | | | | |
|---|---|---|---|---|
| 4,433,711 | A * | 2/1984 | Lew | 160/120 |
| 5,176,774 | A * | 1/1993 | Laniado et al. | 156/162 |
| 5,377,737 | A * | 1/1995 | Moriya et al. | 160/84.06 |
| 5,873,401 | A * | 2/1999 | Tsuchida | 160/84.04 |
| 6,059,007 | A * | 5/2000 | Tomita | 160/242 |
| 6,186,212 | B1 * | 2/2001 | Tsuchida | 160/84.06 |
| 6,318,438 | B1 * | 11/2001 | Uno et al. | 160/31 |
| 6,978,820 | B2 * | 12/2005 | Aoki | 160/84.06 |
| 2005/0241779 | A1 * | 11/2005 | Abouloukme | 160/122 |

FOREIGN PATENT DOCUMENTS

| | | |
|---|---|---|
| JP | 63-98989 | 6/1988 |
| JP | 9-88456 | 3/1997 |
| JP | 2001-73655 | 3/2001 |
| JP | 2002-188380 | 7/2002 |
| JP | 3403652 | 2/2003 |

* cited by examiner

A

B

Prior Art

Prior Art

SCREEN DEVICE

TECHNICAL FIELD

The present invention relates to a screen device which can be opened and closed easily, stably, and smoothly effective to be used for screens, curtains, shutters, blinds, net-screen doors, or interior partitioning for the purpose of shielding, sun-shading, insect-proof, and the like of an opening of a building.

BACKGROUND ART

In the related art, various screen devices are used for shielding, sun-shading, or insect-proofing of openings, such as windows, or entrances in buildings, such as houses, office buildings and so on.

As typical examples of the screen device as described above, there is a roll screen device in which a screen can be wound around a roller pipe for storage and withdrawn for setting up, and a roll screen device provided with a coil spring mechanism for accumulating a resilient force generated by rotation of a roller pipe to be used for winding the screen for storage is also well known.

The coil spring mechanism facilitates opening and closing, that is, operation of setting up and storage. Therefore, taking advantage of this characteristic, there is proposed a screen device in which a roller pipe can be moved without pivotally supporting the same in order to facilitate assembly and mounting of the device in a compact part configuration.

FIG. 8 shows an example, in which a screen 5 which can be withdrawn from a roller pipe 2, wound around the same for storage, and in association with the parallel movement of the slide bar 1 can be set up and opened freely between fixed frames 3, 4. The roller pipe 2 is slidable along a guide rail 10 by a runner 7 provided at the upper end. The roller pipe 2 is provided with a coil spring restoration mechanism 8 for providing a resilient force in the opposite direction of the rotation of the withdrawal of the screen 5, that is, for in the direction of winding of the screen 5. The screen device shown in FIG. 8 includes a runner 6 for a slide bar 1, a cover member 11, a lower rail 12, a locking member 13 as lock mechanism, an engaging member 14 and an unlocking member 15.

FIG. 9 shows another example. This example is a screen device which is openable and closable in the vertical direction, and includes two roller pipes 2A, 2B. The roller pipes 2A, 2B each are also provided with the coil spring restoration mechanism 8 and the screen 5 is mounted thereto. In association with movement of the slide bar 1, the screen 5 can be set up or wound for storage. In order to open and close in the vertical direction, the roller pipes 2A, 2B can be moved by being guided by both end guides 9 along the guide rails 16.

However, the screen devices described above, which are easy to wind the screen for storage has considerable disadvantages.

In the screen device shown in FIG. 8 in which the slide bar 1 moves parallel in the lateral direction, the upper end of the roller pipe 2 is slidable along the guide rail 10 by the runner 7. However, since the lower end is simply adjacent to the lower rail 12 in a free state, in the rotation in association with winding of the screen 5, i.e., the reverse rotation of the screen 5 in the direction of winding caused by the resilient force, a tensile force in the lateral direction which is applied to the roller pipe 2 tends to be unevenly distributed in the direction of the height of the roller pipe 2, and hence the roller pipe 2 is inclined to interfere with the smooth storage and withdrawal of the screen 5, which may result in difficulty of smooth and stable opening and closing operation.

In order to overcome this disadvantage, it has been considered to provide a runner which comes into abutment with the lower rail 12 at the lower end of the roller pipe 2. However, it is not easy to provide well-balanced stable slidability equivalent to the runner 7 at the upper end to the runner at the lower end due to the self-weight or deformation of the roller pipe 2, the screen 5, and the slide bar 1.

In addition, in the screen device shown in FIG. 8, since the lower end of the lower pipe 2 is free, there are inevitable problems such that the screen is deformed and flapped by wind or by contact with human body, and hence difficulty in setting up or storage is encountered, and passage of insects or dust cannot be prevented.

In the screen device shown in FIG. 9, it is very difficult to keep the end guides 9 of the roller pipes 2A, 2B balanced in the horizontal direction during the opening and closing operation, and in fact, in the event that the roller pipes 2A, 2B are inclined, disabling the opening and closing operation cannot be avoided. This problem is also caused by uneven tensile force generated at the roller pipes 2A, 2B upon rotation in the normal and reverse directions.

In the screen device shown in FIG. 9, the influence due to the deformation of the screen 5 caused by wind or contact with human body also cannot be avoided.

Even though the runner is attached to the guides 9, it is extremely difficult to maintain the sliding balance between the right and left sides.

SUMMARY OF THE INVENTION

Accordingly, it is an object of the invention in this application to provide a screen device in which the problems in the related art are solved, smooth and stable opening and closing operation is enabled, exploiting characteristics of the screen device having a roller pipe which rotates and slides for achieving winding of a screen for storage by a resilient force, and the influence of wind or contact with human body can be reduced.

The present invention provides a screen device as follows.

[1] A screen device having a pair of slide guide frames and a slide bar expanding and storing the slide guide frames so that screens can be set up and stored by the movement of the slide bar, wherein a roller pipe having a coil spring mechanism for providing a resilient force integrated therein is arranged between the slide guide frames, pivotally supporting bodies are disposed at both ends of the roller pipe so as to be capable of sliding but not to be capable of rotating with respect to the slide guide frames, one ends of two screens are fixed to the roller pipe, and the roller pipe rotates and slides in association with expansion of the slide guide frames or storage thereof into the slide bar in association with the movement of the slide bar to which the other end of one of the screens is fixed, whereby double-action of setting up of the screen by withdrawal of the same from the roller pipe and storage of the screen into the roller pipe by winding of the same on the roller pipe are enabled.

[2] The screen device according to [1], characterized in that a plurality of the roller pipes are arranged between the slide guide frames, the pivotally supporting bodies are arranged at both ends of the respective roller pipes so as to be capable of sliding but not to be capable of rotating with respect to the slide guide frames, and an end of one of the screens is fixed to the adjacent roller pipe.

[3] The screen device according to [1] or [2], characterized in that one end of the screen is fixed to the roller pipe, and the other end is fixed to the fixed frame.

[4] The screen device according to [1] or [2], characterized in that one end of the screen is fixed to the roller pipe, and the other end thereof is fixed to a second slide bar, so that the slide guide frame can be expanded and stored from and into the second slide bar.

[5] The screen device according to any one of [1] to [4], characterized in that the slide guide frame is an elongated member and has a slit or a notch in the direction orthogonal to the longitudinal direction thereof for facilitating flexure.

[6] The screen device according to any one of [1] to [5], characterized in that the slide guide frame includes a retaining engagement sliding member for the pivotally supporting body to be disposed at the end of the roller pipe.

[7] The screen device according to any one of [1] to [6], characterized in that free ends of the pair of slide guide frames are connected by a tensile member which forms a loop in the shape of an infinity sign in the interior of the slide bar.

[8] The screen device according to any one of [1] to [7], characterized in that the screen can be set up and stored in the lateral direction, vertical direction or oblique direction.

DETAILED DESCRIPTION OF THE INVENTION

Figure 1:
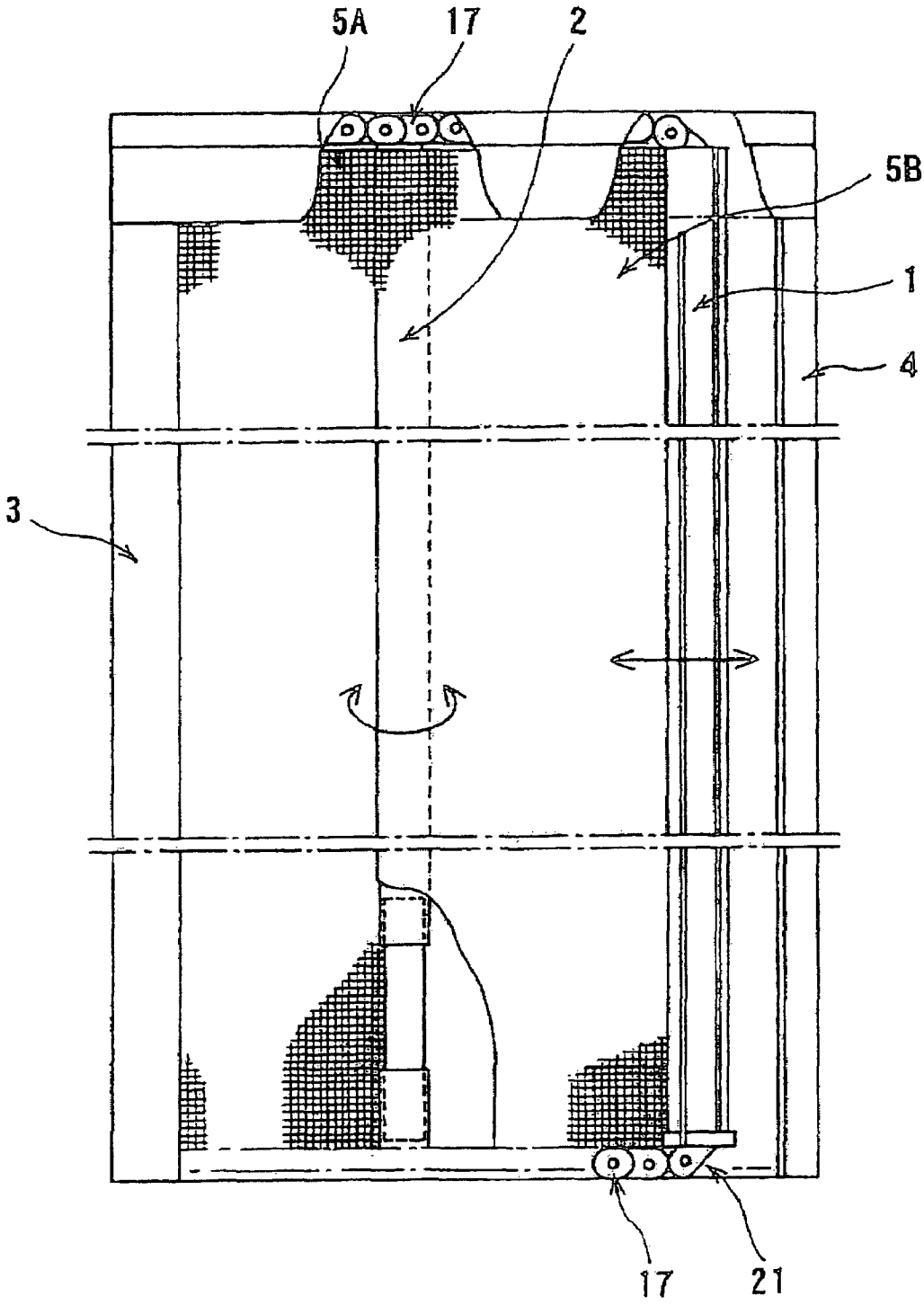
FIG. 1 is a front view showing an embodiment of a screen device.
Figure 2:
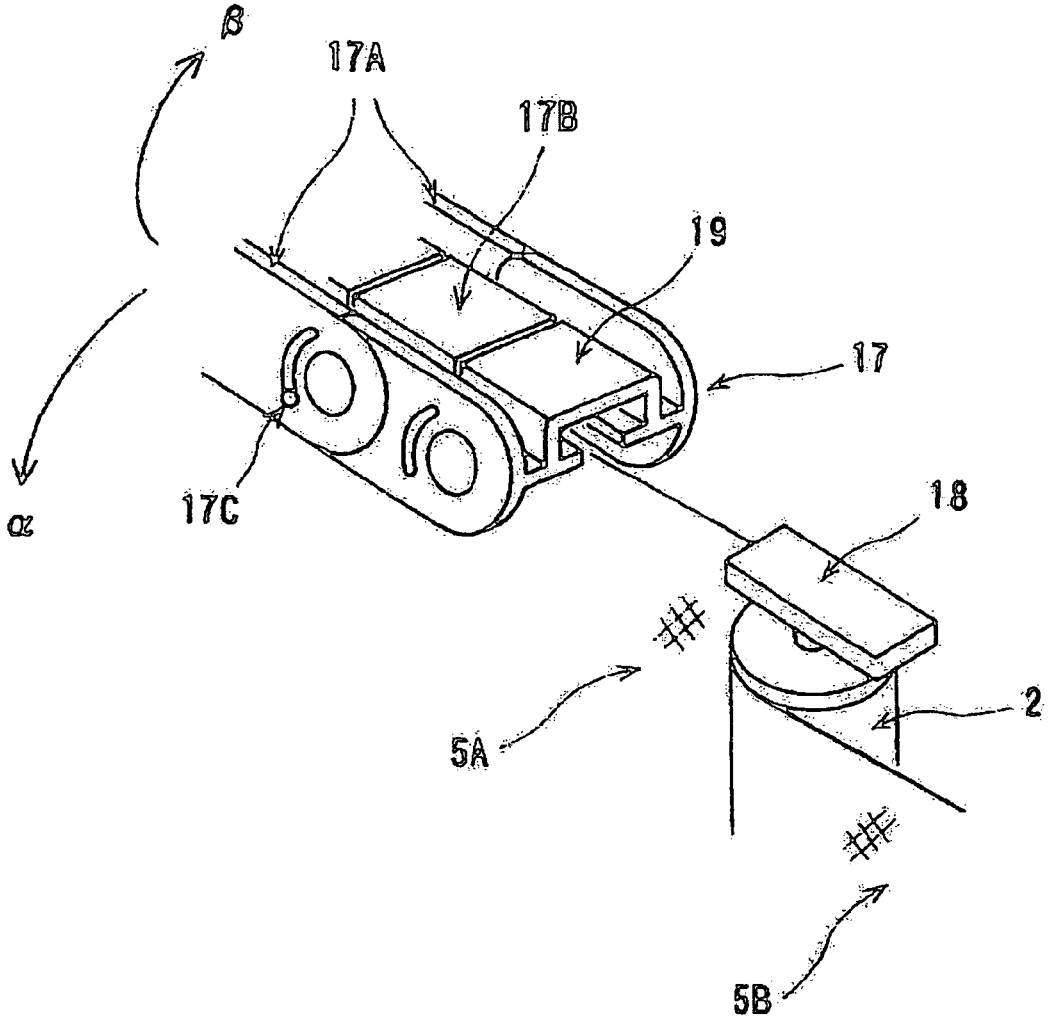
FIG. 2 is a perspective view of a principal portion showing an upper end of a roller pipe, a screen, and a slide guide frame.
Figure 3:
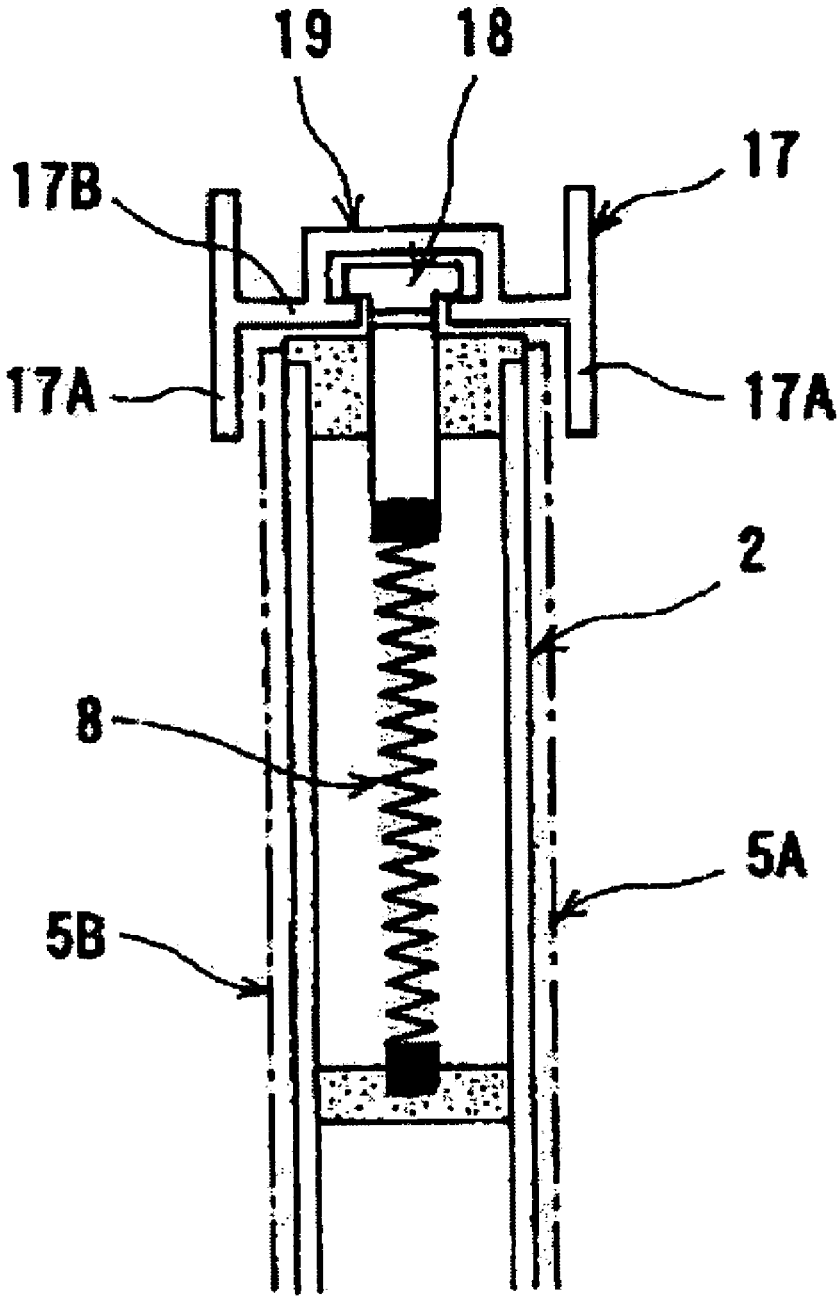
FIG. 3 is a cross-sectional view of a principal portion showing the upper end of the roller pipe, the screen, and the slide guide frame.

In the screen device shown in FIG. 1, a screen 5 is set up between fixed frames 3, 4 by the movement of the slide bar 1 in the lateral direction, and is wound around the roller pipe 2 for storage. More specifically, the screen device shown in FIG. 1 includes a pair of upper and lower slide guide frames 17, which is also shown in FIG. 2 and FIG. 3, a slide bar 1 which is capable of expanding and storing the slide guide frame 17, a roller pipe 2 having a coil spring restoration mechanism 8 for providing a resilient force integrated therein is arranged between the upper and lower slide guide frames 17, and pivotally supporting bodies 18 arranged at both ends of the roller pipe 2 so as to be capable of sliding but not to be capable of rotating with respect to the slide guide frames 17. The slide guide frames 17 are expanded by being withdrawn from the slide bar 1 in association with the movement of the slide bar 1 or are stored by being retracted by the slide bar 1. One end of each of two screens 5A, 5B are fixed to the roller pipe 2, so that the screens 5A, 5B can be withdrawn and wound thereby. The other end of the screen 5A is fixed to a fixed frame 3, and the other end of the screen 5B is fixed to the slide bar 1. In association with rotation and sliding movement of the roller pipe 2, the screens 5A, 5B are withdrawn from the roller pipe 2 and wound on the roller pipe 2. The other end of the screen 5A may be fixed to another slide bar like the slide bar 1 configured in such a manner that the slide guide frames 17 can be expanded therefrom and stored therein.

Figure 8:
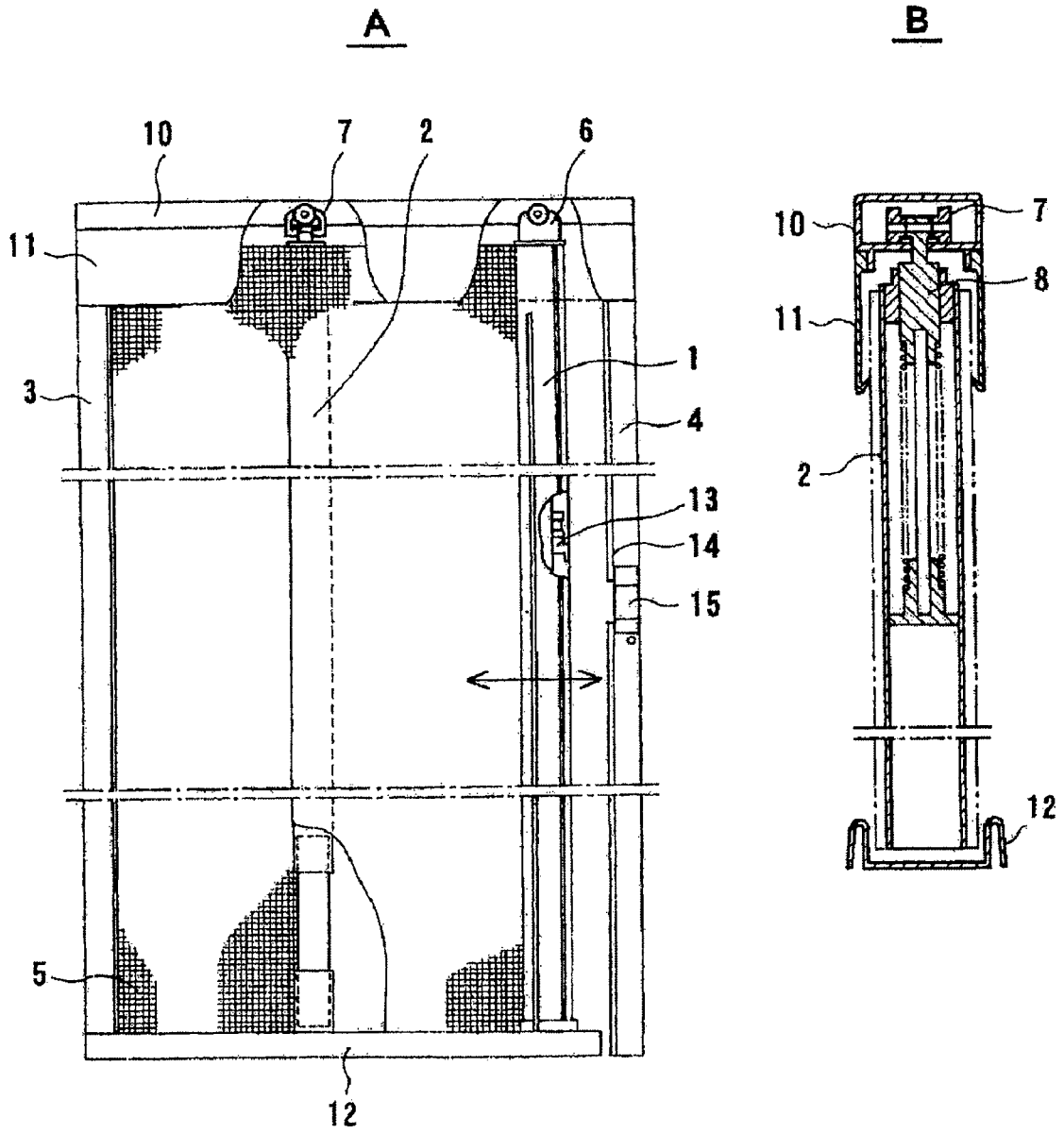
FIG. 8 is a front view (A) and a cross-sectional view (B) showing the screen device configured to be opened and closed in the lateral direction in the related art.

Unlike the fixed guide rail 10 in the related art shown in FIG. 8 which does not change in length and weight, the slide guide frame 17 is changed in length and weight by being withdrawn for expansion from the interior of the slide bar 1 and being stored by retraction into the interior thereof. Therefore, difficulty in the opening and closing operations of the screens 5A, 5B due to being bent in association with their own weight, which cannot be avoided in the case of the guide rail 10, can be avoided.

Figure 4:
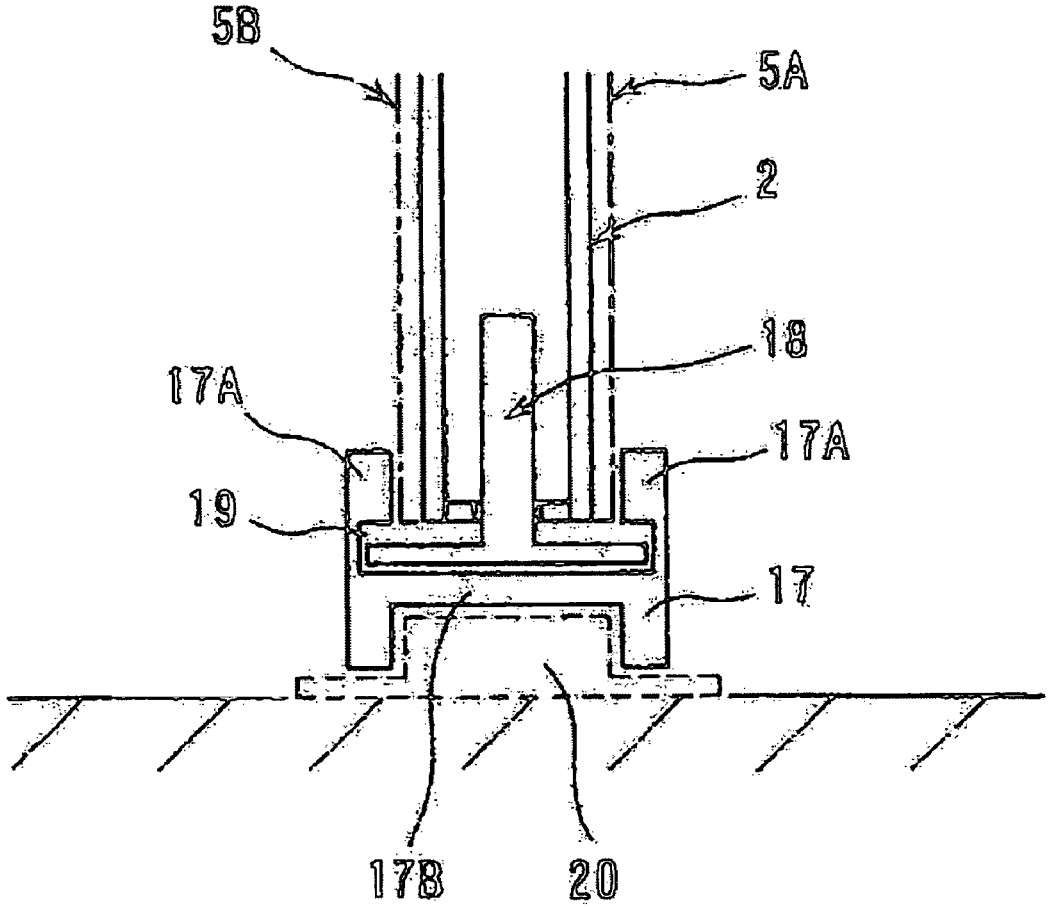
FIG. 4 is a cross-sectional view of the principal portion showing the lower end corresponding to FIG. 3.

Since the pivotally supporting bodies 18 at the both ends of the roller pipe 2 are provided so as to be capable of sliding but not to be capable of rotating with respect to the pair of upper and lower slide guide frames 17, the rotation in the normal direction and in the reverse direction of the roller pipe 2 is stabilized, and hence the setting up and storage of the screens 5A, 5B can be achieved smoothly. As shown in FIG. 2 and FIG. 3, it is more effective to provide the slide guide frames 17 with retaining engagement sliding members 19 for the pivotally supporting bodies 18. As shown in FIG. 4, it is also possible to provide the slide guide frames 17 with the retaining engagement sliding members 19 at the lower end portion.

In the screen device shown in FIG. 1, since the roller pipe 2 is slidably supported at both upper and lower ends thereof by the slide guide frames 17 with the pivotally supporting bodies 18, inconvenience such that the roller pipe 2 is inclined when the roller pipe 2 is rotated in the normal and the reverse direction and hence the screens 5A, 5B are deformed can be avoided. Stable and smooth opening and closing of the screens 5A, 5B and the movement of the slide bar 1 therefore are possible. In addition, the screens 5A, 5B are not deformed or flapped even when an external force is exerted by wind or contact with human body. The passage or entry of dust, foreign substances, or insects from the lower ends of the screens 5A, 5B can also be effectively restrained.

The slide guide frames 17 may be of various structures and configurations as long as they are flexuous enough for enabling withdrawal from the slide bar 1 for expansion and retraction to the slide bar 1 for storage, have linearity for functioning as the guide frames, and have rigidity. They may be formed of various materials, but preferably of light weight materials as much as possible.

As the slide guide frames 17 in this configuration, a combined member of rigid units developed by the applicant of the present invention as shown in FIG. 1, FIG. 2 and FIG. 3 (Japanese Patent No. 3403652) can be employed.

It is a combined member of a plurality of rigid units of the same shape each having a bridge portion 17B located in the middle between side wall portions 17A, and is provided with a stopper mechanism 17C for providing a property which is flexuous in one direction but not in the other direction and retains linearity. The stopper mechanism 17C includes a curved elongated hole and a small projection. In the case of the stopper mechanism 17C shown in FIG. 2, it is flexuous in the direction α, but not in the direction β. Since flexure in the direction β is blocked, the slide guide frames 17 are held rectilinearly.

With the side wall portions 17A which extend upright, passage of dust, foreign substances, insects, and the like can be effectively prevented between the screens 5A, 5B at the lower end of the roller pipe 2. A fixed rail 20 may be arranged in recessed portions on the back sides of the bridge portions 17B, so that the slide guide frames 17 are guided by the fixed rail 20. Even though dust, foreign substances, and the like enter the recesses, since the slide guide frames 17 has an opened portion 21 at a bent portion as shown in FIG. 1, the dust, the foreign substances, and the like are discharged from the opened portion 21, and hence opening and closing operation of the screen device is not hindered.

Figure 5:
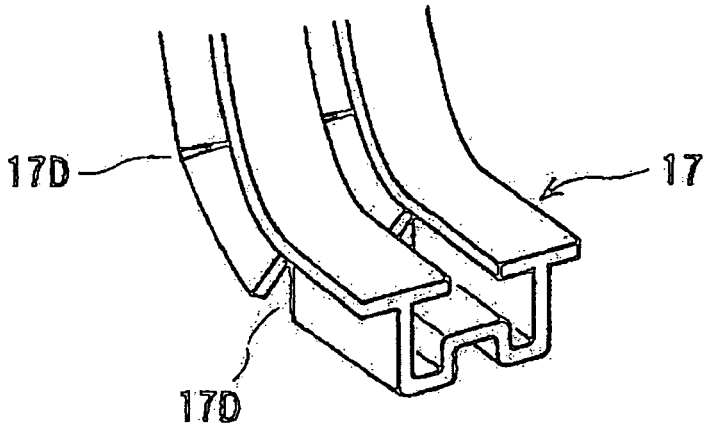
FIG. 5 is a perspective view (A) and a front view (B) showing the slide guide frame according to another embodiment.
Figure 5:
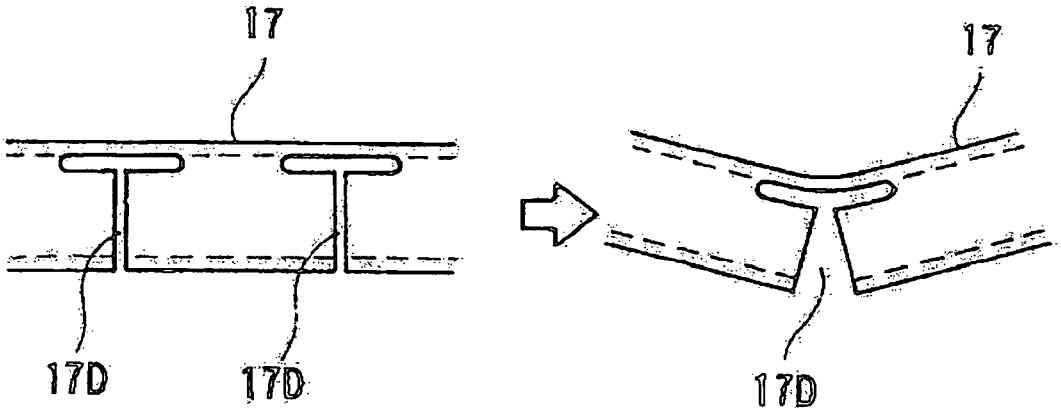

The rigid unit may be, for example, a resin molded product, and the plurality of combined members are not bent at positions where the linearity should be retained, and hence the linearity is reliably retained. Such an effect can be achieved not only by the combined member of rigid units as described above, but also by an elongated member having unidirectional bendability, linearity, and rigidity in combination. FIGS. 5(A), (B) show this example.

In other words, the slide guide frames 17 are an elongated member formed of resin or the like, and have slits 17D or notches which extend orthogonally to the longitudinal direction thereof for facilitating the flexure. As shown in FIG. 5B, it retains the linearity, and is flexuous in one direction in which the slits 17D or the notches are enlarged.

Figure 6:
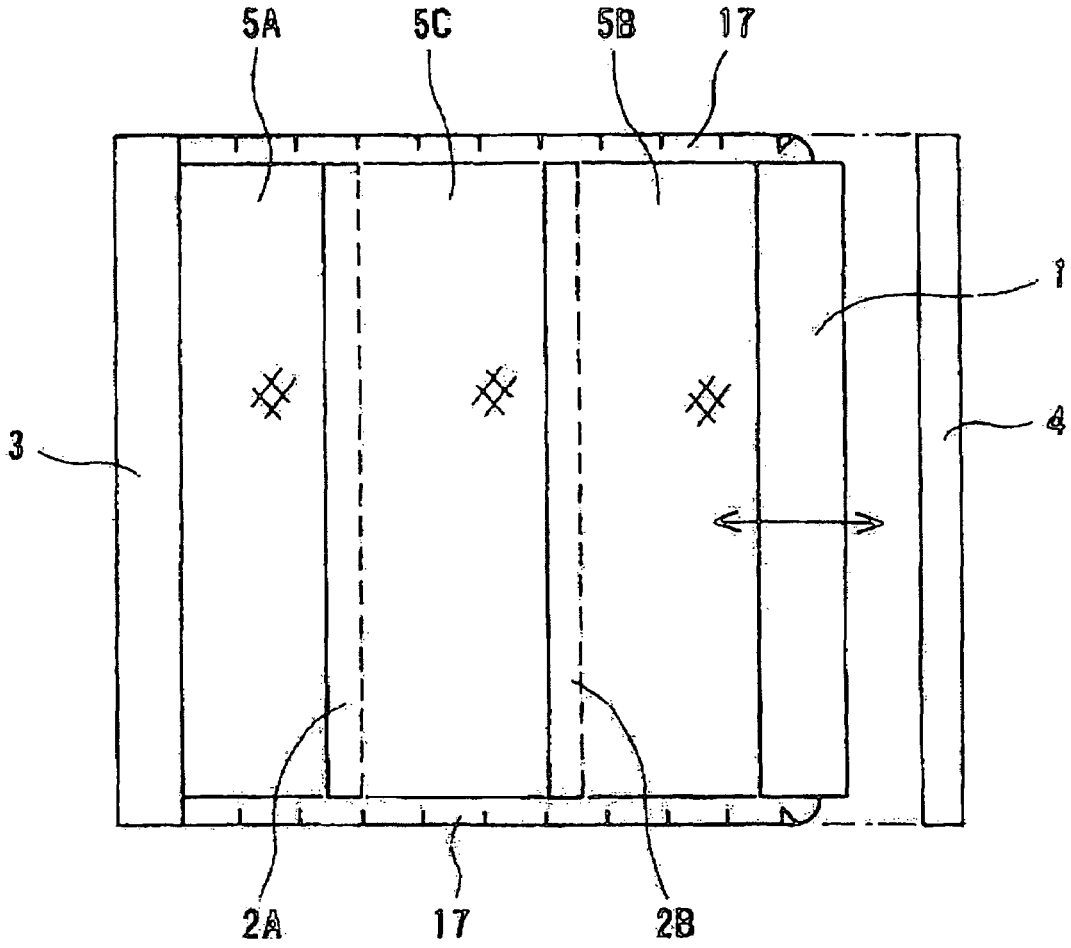
FIG. 6 is a schematic front view showing the screen device provided with a plurality of the roller pipes.

In the screen device shown in FIG. 6, the two roller pipes 2A, 2B are disposed between the slide bar 1 and the fixed frame 3, and three screens 5A, 5B, 5C are mounted in sequence from the fixed frame 3. In this case, the screen 5C is mounted between the roller pipes 2A, 2B. The roller pipes 2 of more than two may be provided.

In any of above-described embodiments of the screen device according to the present invention, with the provision of the flexural slide guide frames 17, flexural resistance serves to attenuate the speed of the roller pipe 2 to wind the screen, so that adequate degree of braking effect is demonstrated. This effect also contributes to the smooth and stable opening and closing operation.

Figure 7:
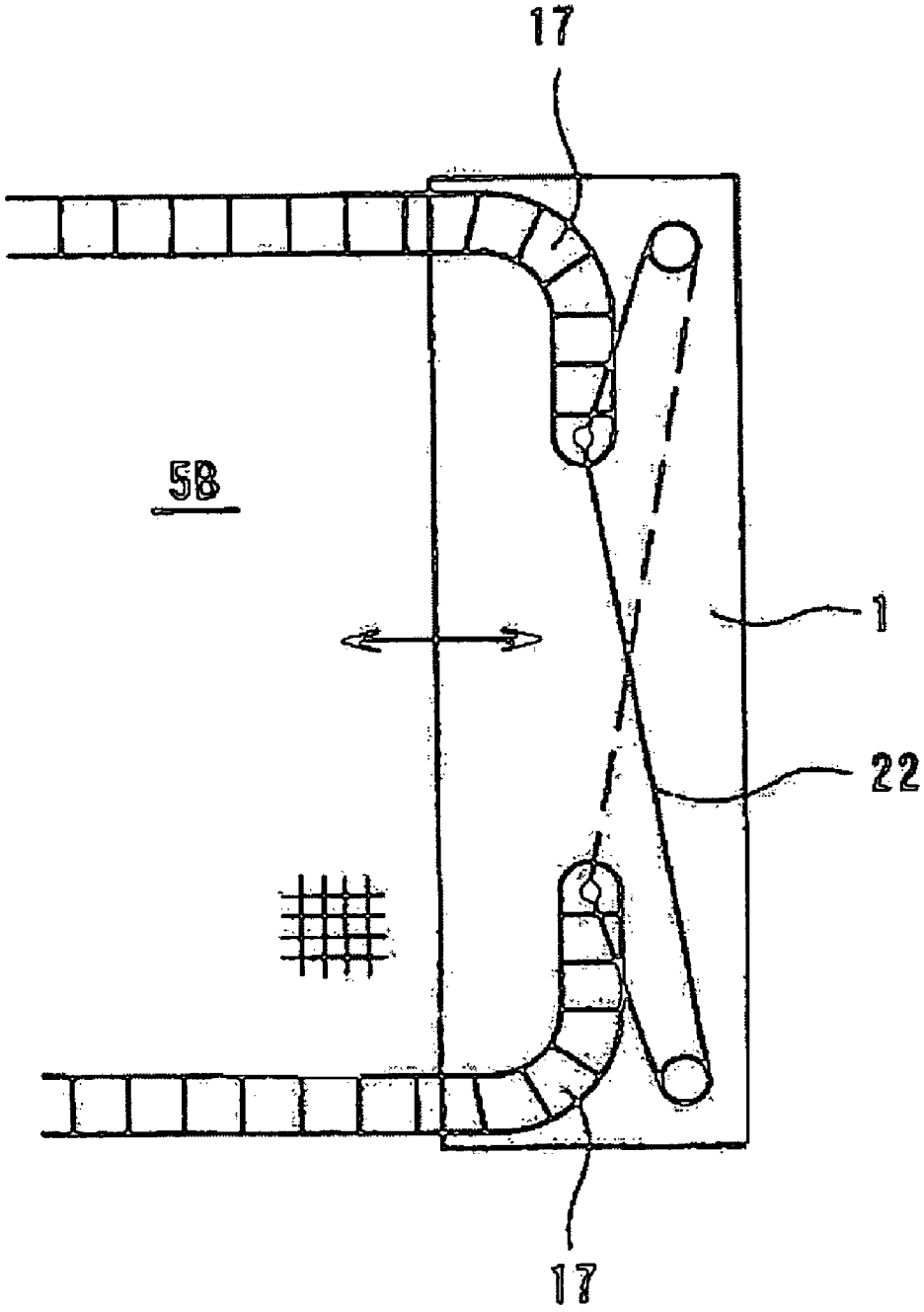
FIG. 7 is a partial cross-sectional view showing a loop.

In order to achieve the smooth and stable opening and closing operation, it is also effective to connect free ends of the pair of slide guide frames 17 by a tensile member 22 which forms a loop in the shape of an infinity sign in the interior of the slide bar 1, as shown in FIG. 7. Although the loop, as described above, is means that is proposed already by the applicant of the present invention (JP-A-2001-73655), the fact that the loop has a remarkable effect in the screen device provided with the roller pipe 2 is proved for the first time.

Figure 9:
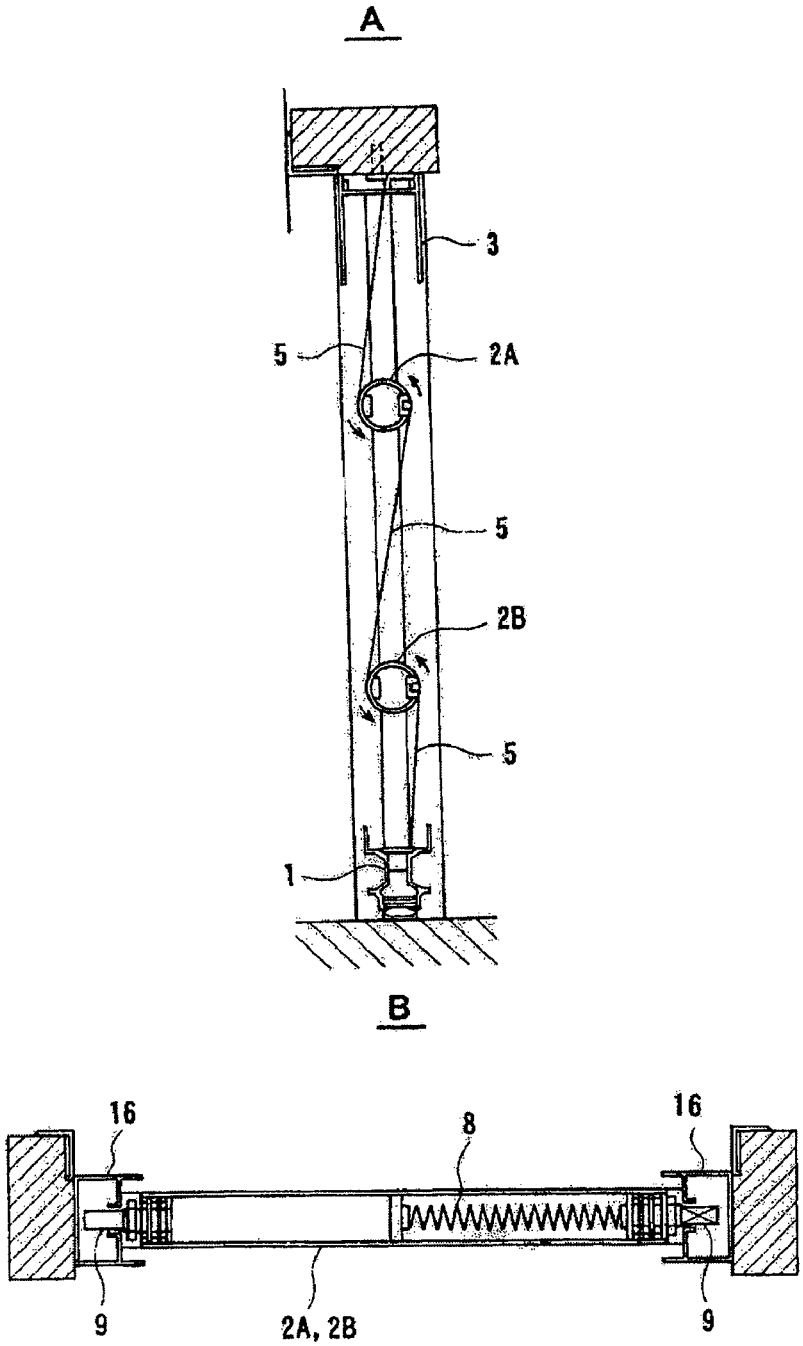
FIG. 9 is a vertical cross-sectional view (A) and a lateral cross-sectional view (B) showing the screen device configured to be opened and closed in the vertical direction in the related art.

The embodiments shown above are the screen device which is configured to be opened and closed in the lateral direction. However, the screen device according to the present invention may be configured to be opened and closed in the vertical direction as shown in FIG. 9 in the related art, or to be opened and closed obliquely. The material of the screen may be natural fibers, synthetic resin, ceramics, metal, alloy, or a combination thereof, and may take various forms such as textile fabric, non-woven fabric, film, sheet, mesh material and so on. The material which can be used for shielding, sun-shading or insect proof of the opening such as a window of the building, or for interior partitioning is selected appropriately.

In the screen device according to the present invention, a tensile force in the winding direction is exerted constantly to the screen. Therefore, the slide bar 1 is constantly urged in the direction of storage. Therefore, in order to expand and set up the screen, employment of a lock means for fixing the position of the slide bar 1 is considered. The lock means may be, for example, a stopper mechanisms provided at the upper and lower ends of the slide bar 1, a locking and engaging mechanism such as a hook between the slide bar 1 and the fixed frame 4, or a magnet attracting member.

Fixation of the screen to the roller pipe 2 or the slide bar 1, or to the fixed frame 3 may be achieved by various known means which is known in the roll screen device in the related art appropriately.

Smooth and stable opening and closing operation of the screen is enabled while exploiting the characteristics of the screen device provided with a roller pipe which rotates and slides to enable winding of a screen for storage by a resilient force generated thereby, and the influence of wind or contact with human body can be restrained.

The invention claimed is:

1. A screen device, comprising:

a pair of slide guide frames;

a slide bar configured to enable the slide guide frames to be expanded therefrom and be stored therein;

a roller pipe having first and second ends and an integrated coil spring mechanism for providing a resilient force, the roller pipe being arranged between the pair of slide guide frames;

pivotally supporting bodies disposed at the first and second ends of the roller pipe;

first and second screens, each screen having a first end fixed to the roller pipe, so as to be withdrawn from and wound around the roller pipe, the first screen having a second end fixed to the slide bar, wherein when the slide guide frames are expanded from and stored in the slide bar in association with movement of the slide bar, the roller pipe rotates and slides via the pivotally supporting bodies along the slide guide frames in the same direction as expansion and storage of the slide guide frames and the same direction that the screens are withdrawn from and wound around the roller pipe.

2. The screen device according to claim 1, wherein the roller pipe is one of a plurality of roller pipes arranged between the pair of slide guide frames, each roller pipe having first and second ends and pivotally supporting bodies configured and arranged at the first and second ends of each of the roller pipes so as to be capable of sliding relative to the slide guide frames and prevent rotation relative to the slide guide frames, and a second end of the second screen is fixed to another roller pipe.

3. The screen device according to claim 1, wherein a second end of the second screen is fixed to a fixed frame.

4. The screen device according to claim 1, wherein a second end of the second screen is fixed to a second slide bar, so that the slide guide frame can be expanded from and stored and in the second slide bar.

5. The screen device according to claim 1, wherein the slide guide frame is an elongated member and has a slit or a notch in the direction orthogonal to the longitudinal direction thereof for facilitating flexure.

6. The screen device according to claim 1, wherein the slide guide frame includes a retaining engagement sliding member for each pivotally supporting body to be disposed at the end of the roller pipe.

7. The screen device according to claim 1, wherein free ends of the pair of slide guide frames are connected by a tensile member, the tensile member forming a loop having the shape of an infinity sign in the interior of the slide bar.

8. The screen device according to claim 1, wherein the screen device is configured to be set up and stored in the lateral direction, vertical direction or oblique direction.

9. The screen device according to claim 2, wherein a second end of the second screen is fixed to a fixed frame.

10. The screen device according to claim 2, wherein a second end of the second screen is fixed to a second slide bar, so that the slide guide frame can be expanded from and stored and in the second slide bar.

11. The screen device according to claim 2, wherein the slide guide frame is an elongated member and has a slit or a notch in the direction orthogonal to the longitudinal direction thereof for facilitating flexure.

12. The screen device according to claim 3, wherein the slide guide frame is an elongated member and has a slit or a notch in the direction orthogonal to the longitudinal direction thereof for facilitating flexure.

13. The screen device according to claim 9, wherein the slide guide frame is an elongated member and has a slit or a notch in the direction orthogonal to the longitudinal direction thereof for facilitating flexure.

14. The screen device according to claim 4, the slide guide frame is an elongated member and has a slit or a notch in the direction orthogonal to the longitudinal direction thereof for facilitating flexure.

15. The screen device according to claim 10, the slide guide frame is an elongated member and has a slit or a notch in the direction orthogonal to the longitudinal direction thereof for facilitating flexure.

16. The screen device according to claim 2, wherein the slide guide frame includes a retaining engagement sliding member for each pivotally supporting body to be disposed at the end of the roller pipe.

17. The screen device according to claim 3, wherein the slide guide frame includes a retaining engagement sliding member for each pivotally supporting body to be disposed at the end of the roller pipe.

18. The screen device according to claim 9, wherein the slide guide frame includes a retaining engagement sliding member for each pivotally supporting body to be disposed at the end of the roller pipe.

19. The screen device according to claim 4, wherein the slide guide frame includes a retaining engagement sliding member for each pivotally supporting body to be disposed at the end of the roller pipe.

20. The screen device according to claim 10, wherein the slide guide frame includes a retaining engagement sliding member for each pivotally supporting body to be disposed at the end of the roller pipe.

* * * * *